US008141743B1

(12) United States Patent
Corrigan

(10) Patent No.: US 8,141,743 B1
(45) Date of Patent: Mar. 27, 2012

(54) DUMPSTER LID SUPPORT SYSTEM

(76) Inventor: Kevin J. Corrigan, North Port, FL (US)

( * ) Notice: Subject to any disclaimer, the term of this patent is extended or adjusted under 35 U.S.C. 154(b) by 305 days.

(21) Appl. No.: 12/321,790

(22) Filed: Jan. 26, 2009

(51) Int. Cl.
*B65D 43/26* (2006.01)
*E05C 3/12* (2006.01)

(52) U.S. Cl. ..... 220/831; 220/263; 220/908; 292/339; 292/288

(58) Field of Classification Search ..... 220/831, 220/263, 826, 832, 908, 810, 264, 262; 16/82; 292/339, 288
See application file for complete search history.

(56) References Cited

U.S. PATENT DOCUMENTS 4,300,796 A * 11/1981 Lane ..... 292/339
4,588,220 A * 5/1986 Matsui et al. ..... 292/338
4,657,155 A * 4/1987 Kendrick ..... 217/60 B
4,819,296 A * 4/1989 Wilkins ..... 16/82
5,011,036 A * 4/1991 Souza et al. ..... 220/263
5,042,856 A 8/1991 Goodman
5,333,922 A * 8/1994 Jones ..... 292/339
5,544,386 A * 8/1996 Cobb ..... 16/82
D375,037 S * 10/1996 Toenders ..... D8/339
5,662,364 A * 9/1997 Reeb et al. ..... 292/230
5,683,126 A 11/1997 Vivo
5,765,416 A * 6/1998 Cote ..... 70/238
5,988,710 A * 11/1999 Kortschot et al. ..... 292/339
6,138,855 A * 10/2000 Kopf ..... 220/263
6,921,566 B2 * 7/2005 Lipstein ..... 428/40.1
7,137,655 B2 * 11/2006 Quarberg ..... 292/339
2002/0180221 A1 * 12/2002 Flowers ..... 292/339
2003/0146230 A1 * 8/2003 Eaton et al. ..... 220/826

* cited by examiner

*Primary Examiner* — J. Gregory Pickett
*Assistant Examiner* — Ernesto Grano

(57) ABSTRACT

A tube assembly has a main body portion in a cylindrical configuration with upper and lower ends. The tube assembly includes an upper component having a downwardly extending section received within the upper end of the main body portion. The upper component has an upwardly extending section and a transitional section coupling the upwardly and downwardly extending sections. The tube assembly includes a lower component having an upwardly projecting section received within the lower end of the main body portion and downwardly projecting sections. The lower component has an intermediate section with opposed ends coupled to the downwardly projecting sections and a center coupled to the upwardly projecting section.

1 Claim, 3 Drawing Sheets

FIG 5
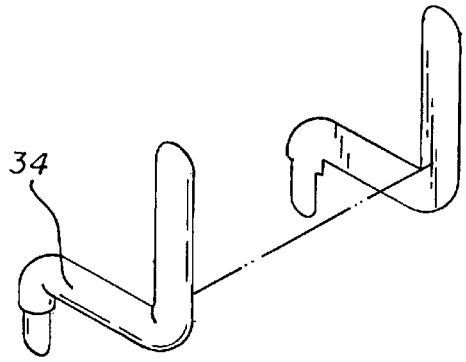
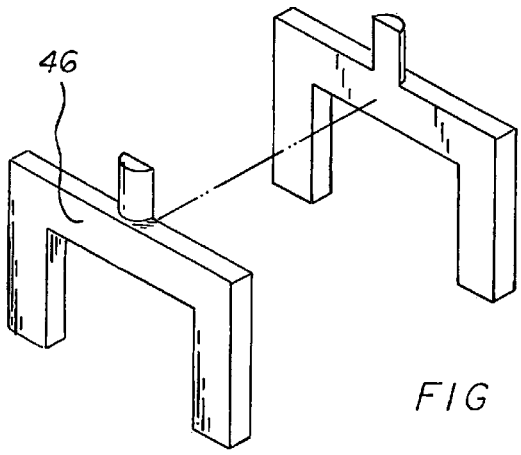
FIG 6

DUMPSTER LID SUPPORT SYSTEM

BACKGROUND OF THE INVENTION

1. Field of the Invention

The present invention relates to a dumpster lid support system and more particularly pertains to holding open access to a dumpster allowing a person to use two hands while disposing of trash in a safe, reliable, convenient and economical manner.

2. Description of the Prior Art

The use of dumpster lid supports of known designs and configurations is known in the prior art. More specifically, dumpster lid supports of known designs and configurations previously devised and utilized for the purpose of supporting dumpster lids are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,683,126 issued Nov. 4, 1997 to Vivo relates to a Dual Lock Assembly for a Container. Also, U.S. Pat. No. 5,042,856 issued Aug. 27, 1991 to Goodman relates to a Automatic Locking Mechanism for Dumpster Lid.

While these devices fulfill their respective, particular objectives and requirements, the aforementioned patents do not describe dumpster lid support system that allows holding open access to a dumpster allowing a person to use two hands while disposing of trash in a safe, reliable, convenient and economical manner.

In this respect, the dumpster lid support system according to the present invention substantially departs from the conventional concepts and designs of the prior art, and in doing so provides an apparatus primarily developed for the purpose of holding open access to a dumpster allowing a person to use two hands while disposing of trash in a safe, reliable, convenient and economical manner.

Therefore, it can be appreciated that there exists a continuing need for a new and improved dumpster lid support system which can be used for holding open access to a dumpster allowing a person to use two hands while disposing of trash in a safe, reliable, convenient and economical manner. In this regard, the present invention substantially fulfills this need.

SUMMARY OF THE INVENTION

In view of the foregoing disadvantages inherent in the known types of dumpster lid supports of known designs and configurations now present in the prior art, the present invention provides an improved dumpster lid support system. As such, the general purpose of the present invention, which will be described subsequently in greater detail, is to provide a new and improved dumpster lid support system and method which has all the advantages of the prior art and none of the disadvantages.

To attain this, the present invention essentially comprises a dumpster which includes a container in a generally rectilinear configuration. The container has a rectangular horizontal bottom. The container also has upwardly extending rectangular front and rear walls and upwardly extending side walls. The walls and the bottom form a chamber for receiving trash and like objects. The side walls are higher at the rear wall than at the front wall. The walls have a peripheral upper edge defining a rectangular upper opening 18 in a plane at about 30 degrees with respect to the bottom.

Included in the dumpster is a lid in a rectangular configuration. The lid is slightly larger than the upper opening. The lid has an upper edge with a hinge pivotably coupling the upper edge of the lid to the upper edge of the rear wall. The lid is movable to a raised orientation to allow disposing of trash and like objects into the chamber of the container. The lid is also movable to a lowered orientation to close the dumpster with the lid in overlapping contact with the upper edge of the container.

Next provided is a tube assembly. The tube assembly has a main body portion in a cylindrical configuration with an upper end and a lower end. The main body portion has an exterior diameter of about 0.75 inches and an interior diameter of about 0.50 inches. The main body portion has a central axis with a length of about 37 inches. The main body portion is essentially rigid and is fabricated of polyvinyl chloride.

The tube assembly includes an upper component in a generally Z-shaped configuration. The upper component has a cylindrical downwardly extending section received within the upper end of the main body portion. The upper component has an upper shoulder in contact with the upper end of the main body portion. The downwardly extending section has a length of about 1.25 inches with a central axis coextensive with the central axis of the tube assembly. The upper component has a cylindrical upwardly extending section having a diameter of about 0.75 inches and a length of about 3 inches with a central axis parallel with, but offset from, the central axis of the downwardly extending section. The upper component has a cylindrical transitional section having a diameter of about 0.75 inches and a length of about 2.125 inches and coupling the upwardly extending section and the downwardly extending section. The transitional section has a central axis perpendicular to the central axes of the upwardly and downwardly extending sections.

The tube assembly includes a lower component in a geometric configuration. The lower component has a cylindrical upwardly projecting section received within the lower end of the main body portion. The upwardly projecting section has a length of about 0.75 inches with a central axis coextensive with the central axis of the main body portion. The lower component has rectilinear downwardly projecting sections with parallel axes offset from the axis of the upwardly projecting section. The lower component has a rectilinear intermediate section with opposed ends coupled to the downwardly projecting sections and a center coupled to the upwardly projecting section. The downwardly projecting sections and the intermediate section form a recess in a second geometric configuration with the axis of each downwardly projecting section being about 2 inches from the axis of the upwardly projecting section. All of the axes are in a common plane. The upper and lower components are molded from acrylonitrile butadiene styrene, ABS, and initially molded in two similarly configured halves split along their axes. An adhesive secures the downwardly extending sections of the upper component to the upper end of the main body portion. An adhesive secures the upwardly extending section of the lower component to the lower end of the main body portion.

Next provided is an elastomeric cap positioned over the upwardly extending section of the upper component. The cap is adapted to contact and frictionally engage the lid of the dumpster while holding the lid in a raised orientation.

Lastly provided is a tape. The tape has an adhesive interior surface for securing the tape to the recess of the lower component. The tape has an exposed abrasive exterior surface positionable against the upper edge of the container above the front wall so as to abate slippage when holding the lid in a raised orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dumpster lid support system which has all of the advantages of the prior art dumpster lid supports of known designs and configurations and none of the disadvantages.

It is another object of the present invention to provide a new and improved dumpster lid support system which may be easily and efficiently manufactured and marketed.

It is further object of the present invention to provide a new and improved dumpster lid support system which is of durable and reliable constructions.

An even further object of the present invention is to provide a new and improved dumpster lid support system which is susceptible of a low cost of manufacture with regard to both materials and labor, and which accordingly is then susceptible of low prices of sale to the consuming public, thereby making such dumpster lid support system economically available to the buying public.

Even still another object of the present invention is to provide a dumpster lid support system for holding open access to a dumpster allowing a person to use two hands while disposing of trash in a safe, reliable, convenient and economical manner.

Lastly, it is an object of the present invention to provide a new and improved dumpster lid support having a tube assembly with a main body portion in a cylindrical configuration with upper and lower ends. The tube assembly includes an upper component having a downwardly extending section received within the upper end of the main body portion. The upper component has an upwardly extending section and a transitional section coupling the upwardly and downwardly extending sections. The tube assembly includes a lower component having an upwardly projecting section received within the lower end of the main body portion and downwardly projecting sections. The lower component has an intermediate section with opposed ends coupled to the downwardly projecting sections and a center coupled to the upwardly projecting section.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded view of the upper component of the support shown in the prior Figures.

FIG. 6 is an exploded view of the lower component of the support shown in the prior Figures.

The same reference numerals refer to the same parts throughout the various Figures.

DESCRIPTION OF THE PREFERRED EMBODIMENT

Figure 1:
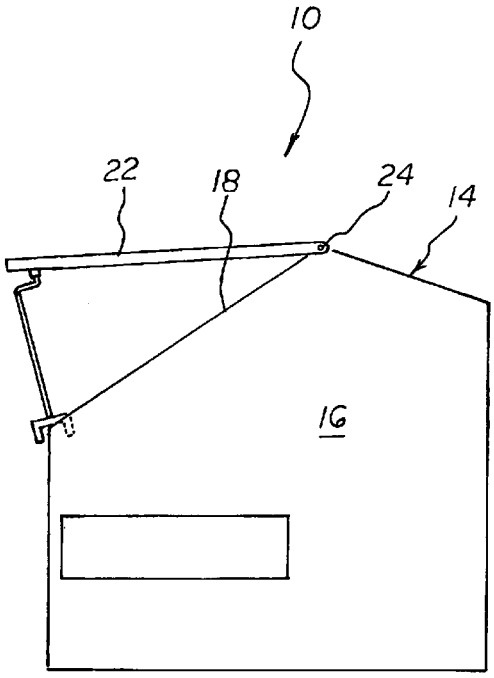
FIG. 1 is a side elevational view of a dumpster lid support system constructed in accordance with the principles of the present invention.
Figure 2:
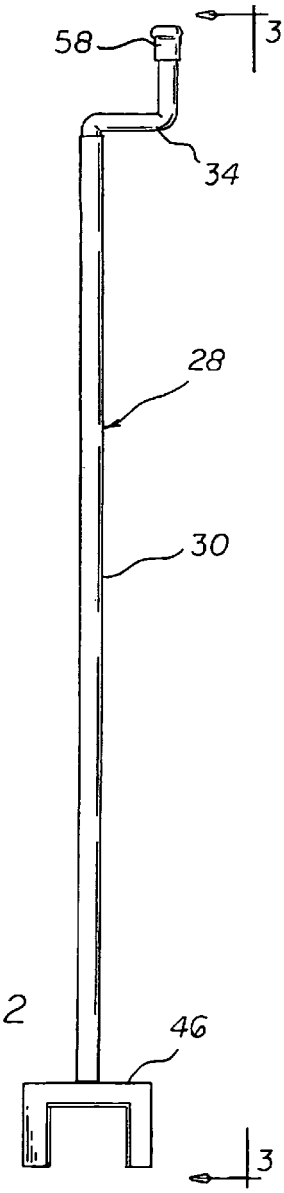
FIG. 2 is a front elevational illustration of the support shown in FIG. 1.
Figure 3:
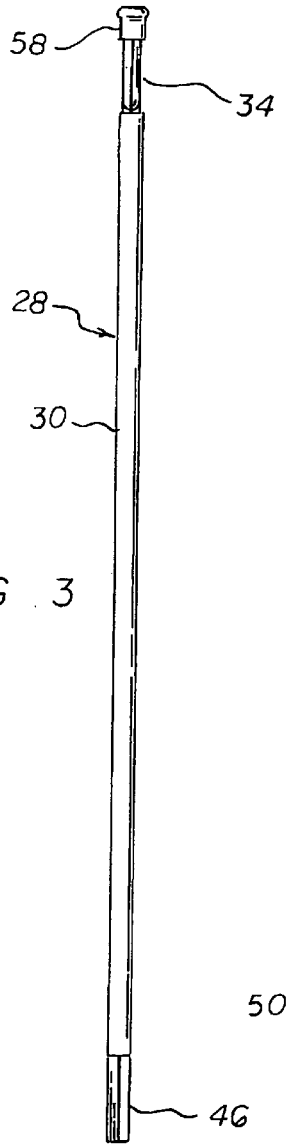
FIG. 3 is a side elevational illustration taken along line 3-3 of FIG. 2.
Figure 4:
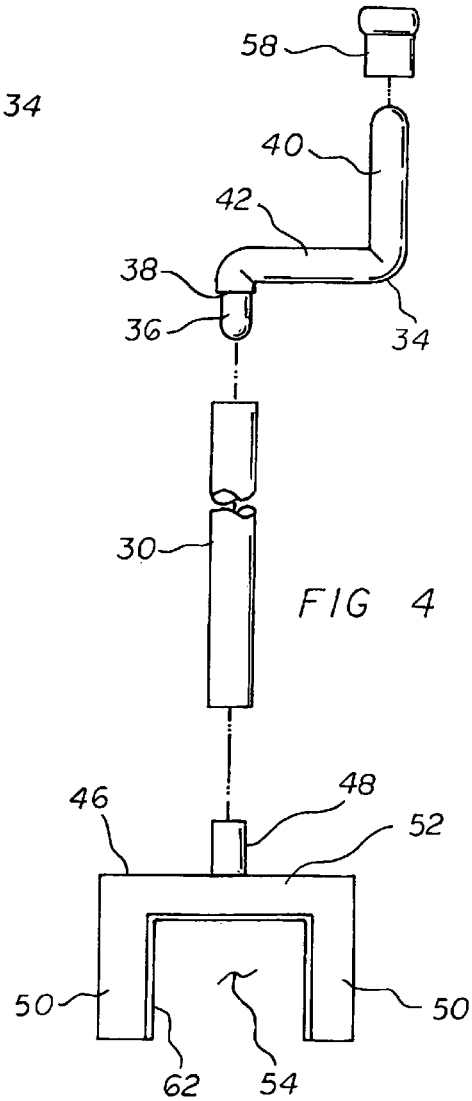
FIG. 4 is a exploded front view of the support shown in the prior Figures.

With reference now to the drawings, and in particular to FIG. 1 thereof, the preferred embodiment of the new and improved dumpster lid support system embodying the principles and concepts of the present invention and generally designated by the reference numeral 10 will be described.

The present invention, the dumpster lid support system 10 is comprised of a plurality of components. Such components in their broadest context include a tube assembly with an upper component and a lower component. Such components are individually configured and correlated with respect to each other so as to attain the desired objective.

The dumpster lid support system 10 is for holding open access to a dumpster thereby allowing a person to use two hands while disposing of trash and like objects. The holding open is done safe, reliable, convenient and economical manner.

First provided is a dumpster 14 including a container 16 in generally rectilinear configuration. The container has a rectangular horizontal bottom. The container also has upwardly extending rectangular front and rear walls and upwardly extending side walls. The walls and the bottom form a chamber for receiving trash and like objects. The side walls are higher at the rear wall than at the front wall. The walls have a peripheral upper edge defining a rectangular upper opening 18 in a plane at about 30 degrees with respect to the bottom.

Included in the dumpster is a lid 22 in a rectangular configuration. The lid is slightly larger than the upper opening. The lid has an upper edge with a hinge 24 pivotably coupling the upper edge of the lid to the upper edge of the rear wall. The lid is movable to a raised orientation to allow disposing of trash and like objects into the chamber of the container. The lid is also movable to a lowered orientation to close the dumpster with the lid in overlapping contact with the upper edge of the container.

Next provided is a tube assembly 28. The tube assembly has a main body portion 30 in a cylindrical configuration with an upper end and a lower end. The main body portion has an exterior diameter of about 0.75 inches and an interior diameter of about 0.50 inches. The main body portion has a central axis with a length of about 37 inches. The main body portion is essentially rigid and is fabricated of polyvinyl chloride.

The tube assembly includes an upper component 34 in a generally Z-shaped configuration. The upper component has a cylindrical downwardly extending section 36 received within the upper end of the main body portion. The upper component has an upper shoulder 38 in contact with the upper end of the main body portion. The downwardly extending section has a length of about 1.25 inches with a central axis coextensive with the central axis of the tube assembly. The upper component has a cylindrical upwardly extending section 40 having a diameter of about 0.75 inches and a length of about 3 inches with a central axis parallel with, but offset from, the central axis of the downwardly extending section. The upper component has a cylindrical transitional section 42 having a diameter of about 0.75 inches and a length of about 2.125 inches and coupling the upwardly extending section and the downwardly extending section. The transitional section has a central axis perpendicular to the central axes of the upwardly and downwardly extending sections.

The tube assembly includes a lower component 46 in a geometric configuration. The lower component has a cylindrical upwardly projecting section 48 received within the lower end of the main body portion. The upwardly projecting section has a length of about 0.75 inches with a central axis coextensive with the central axis of the main body portion. The lower component has rectilinear downwardly projecting sections 50 with parallel axes offset from the axis of the upwardly projecting section. The lower component has a rectilinear intermediate section 52 with opposed ends coupled to the downwardly projecting sections and a center coupled to the upwardly projecting section. The downwardly projecting sections and the intermediate section form a recess 54 in a second geometric configuration with the axis of each downwardly projecting section being about 2 inches from the axis of the upwardly projecting section. All of the axes are in a common plane. The upper and lower components are molded from acrylonitrile butadiene styrene, ABS, and initially molded in two similarly configured halves split along their axes. An adhesive is applied to the two halves of the upper component coupling the two halves together to form the upper component. Similarly, an adhesive is applied to the two halves of the lower component coupling the two halves together to form the lower component. An adhesive secures the downwardly extending sections of the upper component to the upper end of the main body portion. An adhesive secures the upwardly extending section of the lower component to the lower end of the main body portion.

Next provided is an elastomeric cap 58 positioned over the upwardly extending section of the upper component. The cap is adapted to contact and frictionally engage the lid of the dumpster while holding the lid in a raised orientation.

Lastly provided is a tape 62. The tape has an adhesive interior surface for securing the tape to the recess of the lower component. The tape has an exposed abrasive exterior surface positionable against the upper edge of the container above the front wall so as to abate slippage when holding the lid in a raised orientation.

The axes of the downwardly projecting sections are spaced apart by about 8 percent of the length of the main body member and the axis of the upwardly projecting section is spaced from the axis of the main body member by about 11 percent of the length of the main body member.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dumpster lid support system for holding open access to a dumpster thereby allowing a person to use two hands while disposing of trash and like objects, the holding open being done safe, reliable, convenient and economical manner, the system comprising, in combination:

a dumpster including a container in a generally rectilinear configuration, the container having a rectangular horizontal bottom, the container also having upwardly extending rectangular front and rear walls and upwardly extending side walls, the walls and the rectangular horizontal bottom forming a chamber for receiving trash and like objects, the side walls being higher at the rear wall than at the front wall, the walls having a peripheral upper edge defining a rectangular upper opening in a plane at about 30 degrees with respect to the bottom;

the dumpster also including a lid in a rectangular configuration slightly larger than the opening, the lid having an upper edge with a hinge pivotably coupling the upper edge of the lid to the upper edge of the rear wall, the lid being movable to a raised orientation to allow disposing of trash and like objects into the chamber of the container, the lid being movable to a lowered orientation to close the dumpster with the lid in overlapping contact with the upper edge of the container;

a tube assembly having a main body portion in a cylindrical configuration with an upper end and a lower end, the main body portion having an exterior diameter of about 0.75 inches and an interior diameter of about 0.50 inches, the main body portion having a central axis with a length of about 37 inches, the main body portion being essentially rigid and fabricated of polyvinyl chloride;

the tube assembly including an upper component in a generally Z-shaped configuration, the upper component having a cylindrical downwardly extending section received within the upper end of the main body portion with an upper shoulder in contact with the upper end of the main body portion, the downwardly extending section having a length of about 1.25 inches with a central axis coextensive with the central axis of the tube assembly, the upper component having a cylindrical upwardly extending section having a diameter of about 0.75 inches and a length of about 3 inches with a central axis parallel with but offset from the central axis of the downwardly extending section, the upper component having a cylindrical transitional section having a diameter of about 0.75 inches and a length of about 2.125 inches and coupling the upwardly extending section and the downwardly extending section, the transitional section having a central axis perpendicular to the central axes of the upwardly and downwardly extending sections;

the tube assembly including a lower component in a geometric configuration, the lower component having a cylindrical upwardly projecting section received within the lower end of the main body portion, the upwardly projecting section having a length of about 0.75 inches with a central axis coextensive with the central axis of the main body portion, the lower component having rectilinear downwardly projecting sections with parallel axes offset from the axis of the upwardly, projection section, the lower component having a rectilinear intermediate section with opposed ends coupled to the downwardly projecting sections and a center coupled to the upwardly projecting section, the downwardly projecting sections and the intermediate section forming a recess in a second geometric configuration with the axis of each downwardly projecting section being about 2 inches from the axis of the upwardly projecting section, all of the axes being in a common plane, the upper and lower components being molded from acrylonitrile butadiene styrene and initially molded in two similarly configured halves split along their axes, an adhesive coupling the two halves of the upper component, an adhesive coupling the two halves of the lower component, an adhesive securing the downwardly extending section of the upper component to the upper end of the main body portion, an adhesive securing the upwardly extending section of the lower component to the lower end of the main body portion;

an elastomeric cap positioned over the upwardly extending section of the upper component, the cap adapted to contact and frictionally engage the lid of the dumpster while holding the lid in a raised orientation; and a tape having an adhesive interior surface for securing the tape to the recess of the lower component, the tape having an exposed abrasive exterior surface positionable against the upper edge of the container above the front wall so as to abate slippage when holding the lid in a raised orientation.

* * * * *